US006090512A

United States Patent [19]

Saita

[11] Patent Number: 6,090,512

[45] Date of Patent: Jul. 18, 2000

[54] ELECTROPHOTOGRAPHIC PHOTORECEPTOR

[75] Inventor: Atsuo Saita, Ibaraki, Japan

[73] Assignee: Mitsubishi Chemical Corporation, Tokyo, Japan

[21] Appl. No.: 09/321,881

[22] Filed: May 28, 1999

[30] Foreign Application Priority Data

Jun. 4, 1998 [JP] Japan ..... 10-155815

[51] Int. Cl.[7] ..... G03G 5/06

[52] U.S. Cl. ..... 430/58.5; 430/58.75; 430/74; 430/78

[58] Field of Search ..... 430/58.5, 58.75, 430/74, 78

[56] References Cited

U.S. PATENT DOCUMENTS

| | | | |
|---|---|---|---|
| 5,168,025 | 12/1992 | Ono et al. | 430/59 |
| 5,284,728 | 2/1994 | Murayama et al. | 430/59 |
| 5,324,605 | 6/1994 | Ono et al. | 430/59 |
| 5,338,633 | 8/1994 | Nozomi et al. | 430/58.5 |
| 5,389,480 | 2/1995 | Ono et al. | 430/59 |
| 5,389,481 | 2/1995 | Saita et al. | 430/59 |
| 5,753,393 | 5/1998 | Mitsumori et al. | 430/59 |

FOREIGN PATENT DOCUMENTS 5-210251 8/1993 Japan .

*Primary Examiner*—John Goodrow

*Attorney, Agent, or Firm*—Oblon, Spivak, McClelland, Maier & Neustadt, P.C.

[57] ABSTRACT

An electrophotographic photoreceptor includes a conductive substrate and a photosensitive layer on the conductive substrate. The photosensitive layer contains an arylamine compound of a formula (I):

(I)

where $A_1$, $A_2$, $A_3$ and $A_4$ each independently represents a substituted or unsubstituted group selected from an alkyl group, an aralkyl group, an aryl group, a heterocyclic group and a condensed polycyclic group; Y represents a substituted or unsubstituted group selected from an alkylene group, an aralkylene group, an alkenylene group, an arylene group, and a bivalent heterocyclic group; and $R_1$, $R_2$, $R_3$, $R_4$, $R_5$, $R_6$, $R_7$ and $R_8$ each independently represents a hydrogen atom or a substituent selected from a hydroxyl group, a halogen atom, and a substituted or unsubstituted group selected from an alkyl group, an alkoxy group, an aralkyl group, an aralkyloxy group, an aryl group, an aryloxy group, a heterocyclic group, a heterocyclicoxy group, a condensed polycyclic group and an amino group.

12 Claims, 1 Drawing Sheet

ELECTROPHOTOGRAPHIC PHOTORECEPTOR

BACKGROUND OF THE INVENTION

1. Field of the Invention

The present invention relates to an electrophotographic photoreceptor, and in particular to a highly sensitive, high-performance electrophotographic photoreceptor having a photoconductive layer that contains organic photoconductive materials.

2. Discussion of the Background

Conventionally, inorganic photoconductive materials, such as selenium, cadmium sulfide, and zinc oxide, have been widely used for photosensitive layers of electrophotographic photoreceptors. These known materials, however, have the following disadvantages: selenium and cadmium sulfite need to be disposed of as toxicants, selenium becomes crystalline upon heating, and thus has a poor heat resistance, cadmium sulfide and zinc oxide have poor moisture resistance, and zinc oxide has an extremely low resistance to repeated printing operations. Thus, considerable efforts have been put into development of novel photoreceptors. In recent years, extensive studies have been conducted on the use of organic photoconductive materials for photosensitive layers of electrophotographic photoreceptors, and some of such materials have been put in practical use. Compared to known photoconductive inorganic materials, organic photoconductive materials are advantageously light-weight, innocuous or non-poisonous to environments, form films easily, and facilitate the manufacture of photoreceptors. In addition, the use of an organic photoconductive material makes it possible to produce a transparent photoreceptor, depending upon the type of the material.

Recently, so-called function-separation-type photoreceptors, in which different types of compounds are respectively used to perform the separate functions of charge carrier generation and charge carrier transportation, have been developed, and photoreceptors of this type using an organic material(s) have been used. For charge carrier transport material a high molecular weight polymeric photoconductive compound, such as polyvinyl carbazole, is used in some applications, and a low molecular weight photoconductive compound that is dispersed or dissolved in a binder polymer is used in other applications.

In particular, the use of such a low-molecular weight organic photoconductive compound makes it easy to provide a photoreceptor having excellent mechanical characteristics, since a polymer having high film-formability, flexibility, and adhesive property, may be selected as a binder, as disclosed in, for example, unexamined Japanese Patent Publication (Kokai) No. 63-269160, and examined Japanese Patent Publications No. 3-39306 and No. 4-53308. However, it has been difficult to find a compound that is suitable for producing a photoreceptor having a sufficiently high sensitivity.

U.S. Pat. No. 5,338,633 discloses an electrophotographic photoreceptor comprising a photoconductive layer containing the following compound:

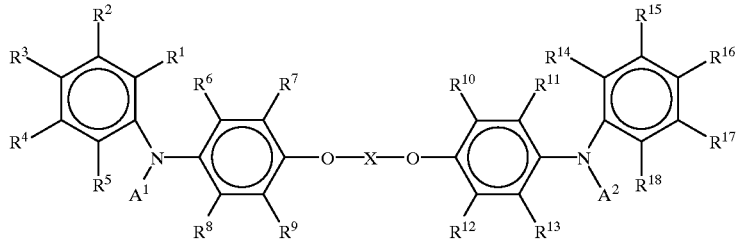

In the compound, —O—X—O— is bonded to two phenyl groups at positions para to nitrogen atoms bonded to the phenyl groups. In contrast, the compound of formula (I) of the present invention has a —O—Y—O— group bonded to two phenyl groups at positions meta to nitrogen atoms bonded to the phenyl groups.

JP-A-5-210251 discloses an electrophotographic photoreceptor comprising a photosensitive layer containing a compound of the following formula:

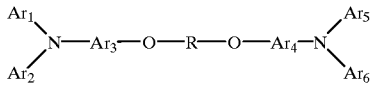

where $Ar_1$, $Ar_2$, $Ar_3$, $Ar_4$, $Ar_5$ and $Ar_6$ each represent an aryl, biphenyl or heterocyclic group that can be substituted or unsubstituted, and R represents an alkylene group, a aralkylene group, and alkelene group or a heterocyclic group. In the above formula, —O—R—O— can be bonded to the adjacent $Ar_3$ and $Ar_4$ at any position relative to the respective nitrogen atoms. However, the specific compounds disclosed in JP-A-5-210251 have —O—R—O— bonded to adjacent $Ar_3$ and $Ar_4$ only at positions para to the respective bonded nitrogen atoms.

There is a need for a photoconductive compound that is suitable for producing a high sensitivity electrophotographic photoreceptor.

SUMMARY OF THE INVENTION

As a result of intensive studies on low molecular weight organic photoconductive compounds, the inventor of the present invention has found that a particular type of arylamine compound can be suitably used as a photoconductive compound, and thus reached the present invention. More specifically, the present invention provides an electrophotographic photoreceptor comprising a photosensitive layer formed on a conductive substrate, wherein said photosensitive layer contains an arylamine compound of the formula (I):

(I)

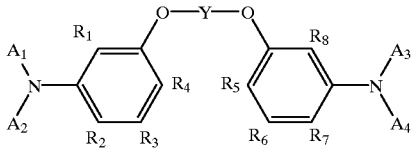

where $A_1$, $A_2$, $A_3$ and $A_4$ each independently represents a substituted or unsubstituted group selected from an alkyl group, an aralkyl group, an aryl group, a heterocyclic group, and a condensed polycyclic group; Y represents a substituted or unsubstituted group selected from an alkylene group, an aralkylene group, an alkenylene group, an arylene group, and a bivalent heterocyclic group; and $R_1$, $R_2$, $R_3$, $R_4$, $R_5$, $R_6$, $R_7$ and $R_8$ each independently represents a hydrogen atom or a substituent selected from a hydroxyl group, a halogen atom, and a substituted or unsubstituted group selected from an alkyl group, an alkoxy group, an aralkyl group, an aralkyloxy group, an aryl group, an aryloxy group, a heterocyclic group, a heterocyclicoxy group, a condensed polycyclic group and an amino group.

DETAILED DESCRIPTION OF THE PRESENT INVENTION

Figure 1:
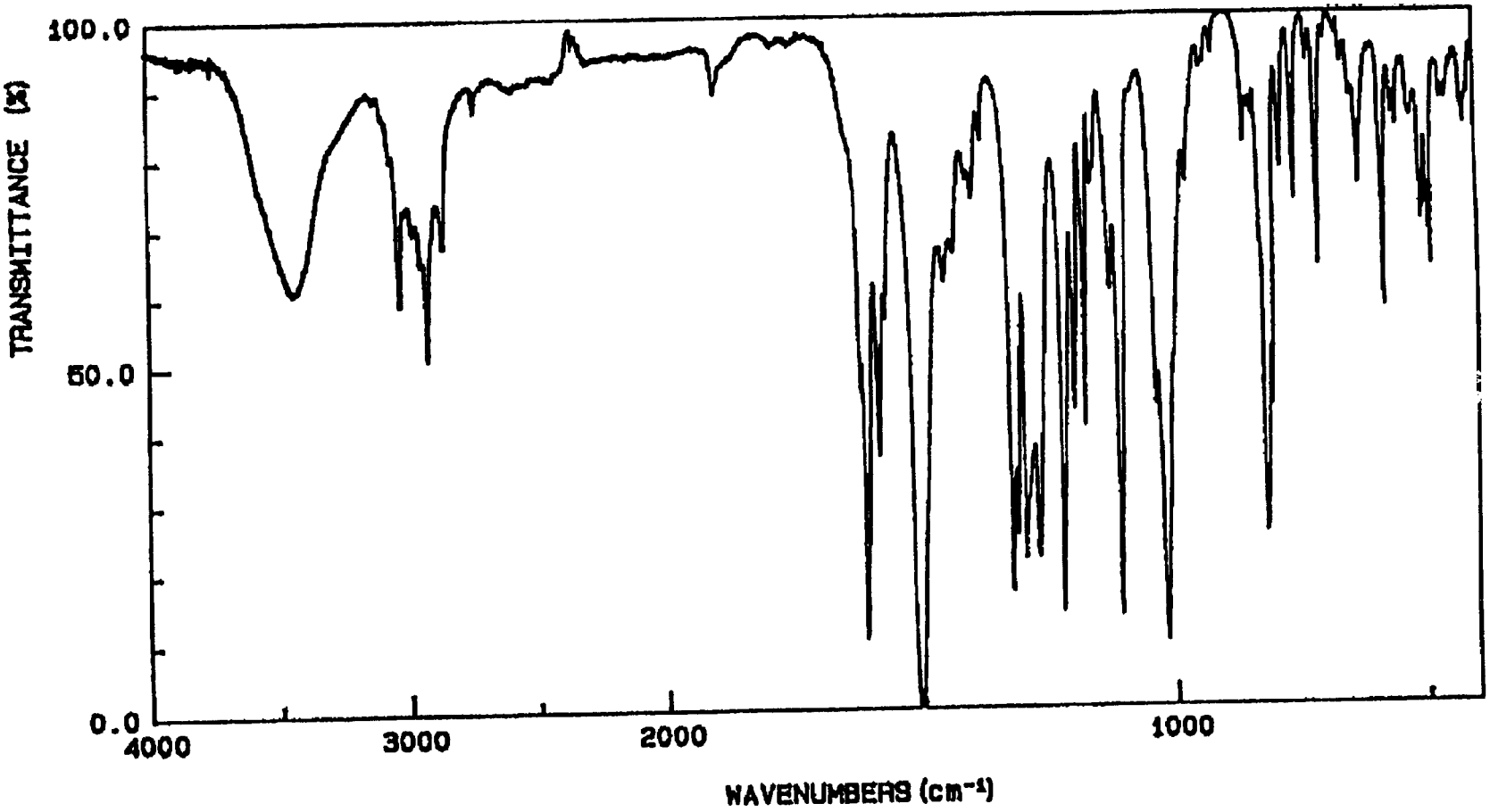
FIG. 1 is a diagram showing an infrared absorption spectrum of an arylamine compound prepared by Synthesis Example 1.

The electrophotographic photoreceptor according to the present invention includes a photosensitive layer that contains an arylamine compound of the formula (I) as indicated above.

In the above-indicated formula (I), $A_1$, $A_2$, $A_3$ and $A_4$ each independently represents a substituted or unsubstituted group selected from an alkyl group, an aralkyl group, an aryl group, a heterocyclic group and a condensed polycyclic group. For example, the alkyl group can be a methyl group, an ethyl group, a propyl group, a butyl group or a hexyl group. The aralkyl group can be a benzyl group, a naphthylmethyl group or a phenethyl group. The aryl group can be a phenyl group or a naphthyl group. The heterocyclic group can be a thienyl group, a furyl group or a pyridyl group. The condensed polycyclic group can be a pyrenyl group, a anthracenyl group or a fluorenyl group. Preferably $A_1$, $A_2$, $A_3$ and $A_4$ are each an aryl group or a condensed polycyclic group.

Substituents on $A_1$, $A_2$, $A_3$ and $A_4$ can include a hydroxyl group, a halogen atom, such as a chlorine atom, a bromine atom, and an iodine atom; an alkyl group, such as a methyl group, an ethyl group, a propyl group, a butyl group, and a hexyl group; an alkoxy group, such as a methoxy group, an ethoxy group, and a butoxy group; an allyl group; an allyloxy group; aralkyl group, such as a benzyl group, naphthylmethyl group, and a phenethyl group; an aryloxy group, such as a phenoxy group and a tolyloxy group; an aralkyloxy group, such as a benzyloxy group and a phenethyloxy group; an aryl group, such as a phenyl group and a naphthyl group; a heterocyclic group, such as a thienyl group and a furyl group; an arylvinyl group, such as a styryl group and a naphthylvinyl group; a dialkylamino group, such as a dimethylamino group and a diethylamino group; a diarylamino group, such as a diphenylamino group and a dinaphthylamino group; a diaralkylamino group, such as a dibenzylamino group and a diphenethylamino group; a diheterocyclic group, such as a dithienylamino group and a difurylamino group; a diallylamino group; a di-substituted amino group as a combination of the above-listed amino groups; a nitro group; and an acyl group, such as an acetyl group and a benzoyl group.

Y in the above formula (I) can be a substituted or unsubstituted group selected from: an alkylene group, such as a methylene group, ethylene group, and a propylene group; an aralkylene group such as a xylylene group; an alkenylene group, such as a vinylene group, propenylene group, butenylene group, and a butadiene group; an arylene group, such as a phenylene group, biphenylene group, and a naphthalene group; and a bivalent heterocyclic group, such as a thienylene group and a furylene group. In particular, an alkylene group is preferred.

Substituents on Y can include a hydroxyl group; a halogen atom, such as a chlorine atom, bromine atom, and an iodine atom; an alkyl group, such as a methyl group, an ethyl group, a propyl group, a butyl group, and a hexyl group; an alkoxy group, such as a methoxy group, an ethoxy group, and a butoxy group; an allyl group; an allyloxy group; aralkyl group, ws such as a benzyl group, a naphthylmethyl group, and a phenethyl group; an aryloxy group, such as a phenoxy group and a tolyloxy group; aralkyloxy group, such as a benzyloxy group and a phenethyloxy group; an aryl group, such as a phenyl group and a naphthyl group; a heterocyclic group, such as a thienyl group and a furyl group; an arylvinyl group, such as a styryl group and a naphthylvinyl group; a dialkylamino group, such as a dimethylamino group and a diethylamino group; a diarylamino group, such as a diphenylamino group and a dinaphthylamino group; a diaralkylamino group, such as a dibenzylamino group and a diphenethylamino group; a diheterocyclic group, such as a dithienylamino group and a difurylamino group; a diallylamino group; a di-substituted amino group as a combination of the above-listed amino groups; a nitro group; and an acyl group, such as an acetyl group and a benzoyl group.

$R_1$, $R_2$, $R_3$, $R_4$, $R_5$, $R_6$, $R_7$ and $R_8$ each independently represents a hydrogen atom or a substituent selected from a hydroxyl group; a halogen atom, such as a chlorine atom, a bromine atom, and an iodine atom; an alkyl group, such as a methyl group, an ethyl group, a propyl group, a butyl group, and a hexyl group; an alkoxy group, such as a methoxy group, an ethoxy group, and a butoxy group; an aralkyl group, such as a benzyl group, a naphthylmethyl group, and a phenethyl group; an aralkyloxy group, such as a benzyloxy group and a phenethyloxy group; an aryl group, such as a phenyl group and a naphthyl group; an aryloxy group, such as a phenoxy group and a tolyloxy group; a heterocyclic group, such as a thienyl group and a furyl group; a heterocyclicoxy group, such as a thienyloxy group and a furyloxy group; a condensed polycyclic group, such as a pyrenyl group, anthracenyl group, and a fluorenyl group; an amino group; a dialkylamino group, such as a dimethylamino group and a diethylamino group; a diarylamino group, such as a diphenylamino group, ditolylamino group, and a dinaphthylamino group; a diaralkylamino group, such as a dibenzylamino group and a diphenethylamino group; a diheterocyclic amino group, such as a dithienylamino group and a difurylamino group; a diallylamino group; and a di-substituted amino group as a combination of the above-listed amino groups. Preferably, $R_1$, $R_2$, $R_3$, $R_4$, $R_5$, $R_6$, $R_7$ and $R_8$ are each a hydrogen atom, an alkyl group or aryl group.

Substituents, where possible, on $R_1$, $R_2$, $R_3$, $R_4$, $R_5$, $R_6$, $R_7$ and $R_8$ can include a hydroxyl group; a halogen atom, such as a chlorine atom, a bromine atom, and an iodine atom; an alkyl group, such as a methyl group, an ethyl group, a propyl group, a butyl group, and a hexyl group; an alkoxy group, such as a methoxy group, an ethoxy group, and a butoxy group; an allyl group; an allyloxy group; aralkyl group, such as a benzyl group, a naphthylmethyl group, and a phenethyl group; an aryloxy group, such as a phenoxy group and a tolyloxy group; an aralkyloxy group, such as a benzyloxy group and a phenethyloxy group; an aryl group, such as a phenyl group and a naphthyl group; a heterocyclic group, such as a thienyl group and a fuiryl group; an arylvinyl group, such as a styryl group and a naphthylvinyl group; a dialkylamino group, such as a dimethylamino group and a diethylamino group; a diarylamino group, such as a diphenylamino group and a dinaphthylamino group; a diaralkylamino group, such as a dibenzylamino group and a diphenethylamino group; a diheterocyclic group, such as a dithienylamino group and a difurylamino group; a diallylamino group; a di-substituted amino group as a combination of the above-listed amino groups; a nitro group; and an acyl group, such as an acetyl group and a benzoyl group.

Preferably, at least one of $R_4$ and $R_5$, which are positioned para to the $NA_1A_2$ and $NA_3A_4$ groups in formula (I) respectively, is a hydroxyl group, a halogen atom, or a substituted or unsubstituted group selected from an alkyl group, an alkoxy group, an aralkyl group, an aralkyloxy group, an aryl group, an aryloxy group, a heterocyclic group, a heterocyclicoxy group, a condensed polycyclic group, and an amino group.

Typical compounds of arylamine compounds of the formula (I) are shown in TABLE 1 below, by way of example. It is, however, to be understood that the arylarine compound used in the present invention is not limited to these typical compounds.

TABLE 1

| Compound No. | Compound |
|---|---|
| 1 | 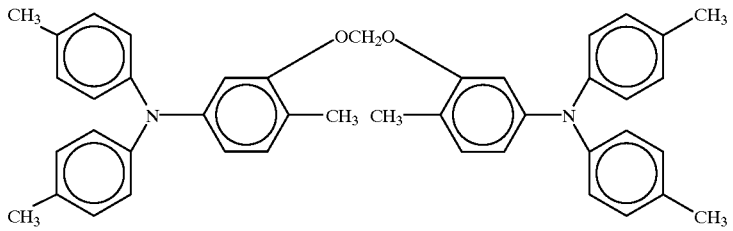 |
| 2 | 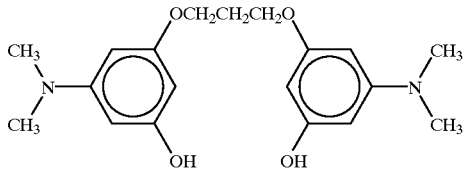 |
| 3 | 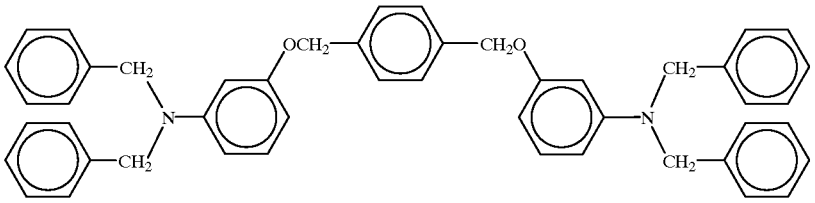 |
| 4 | 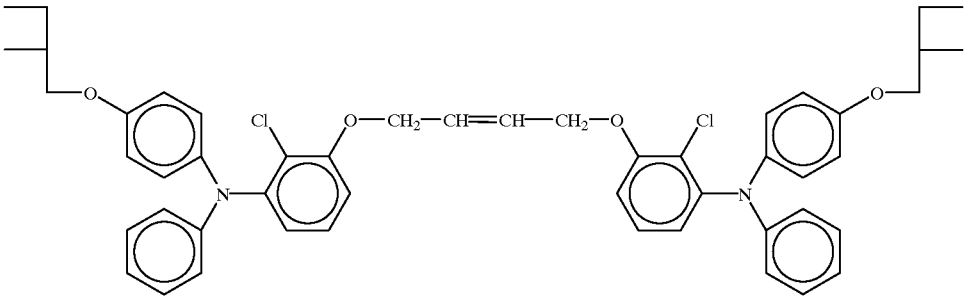 |

TABLE 1-continued
| Compound No. | Compound |
|---|---|
| 5 | 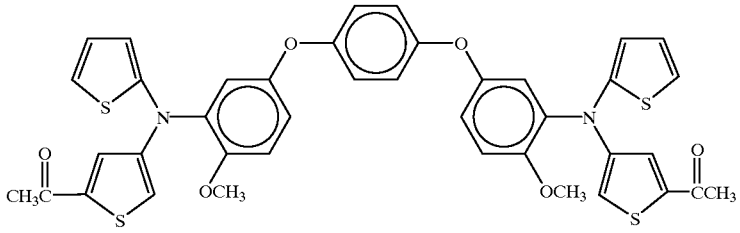 |
| 6 | 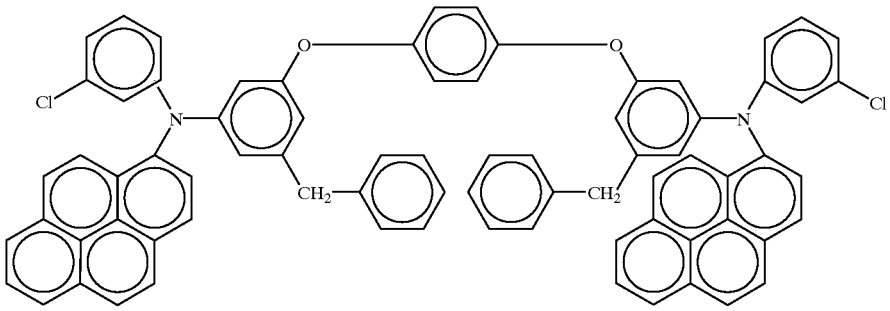 |
| 7 | 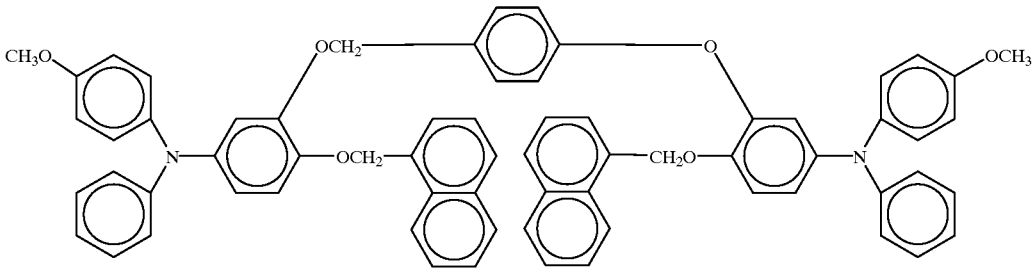 |
| 8 | 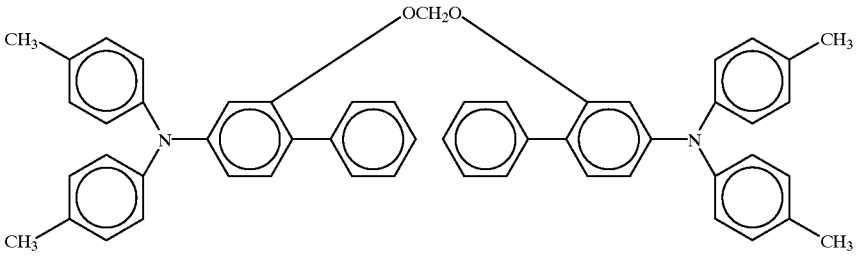 |
| 9 | 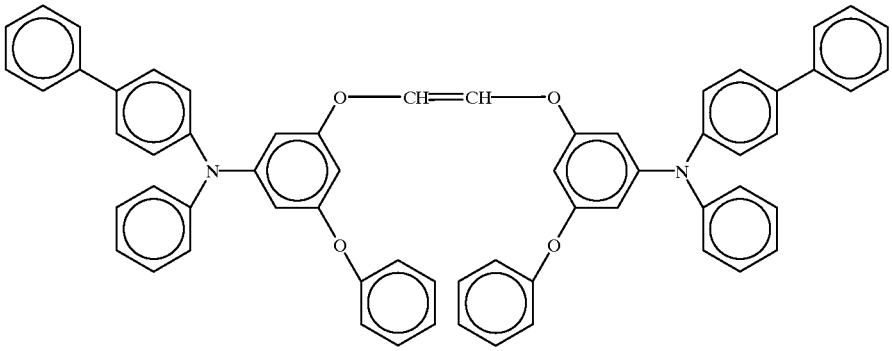 |

TABLE 1-continued
| Compound No. | Compound |
|---|---|
| 10 | 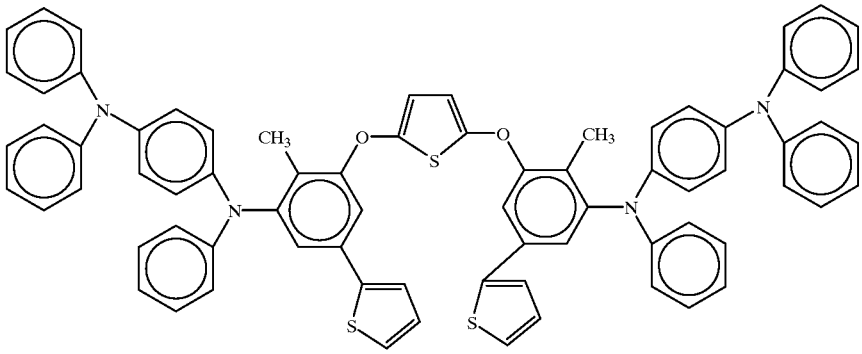 |
| 11 | 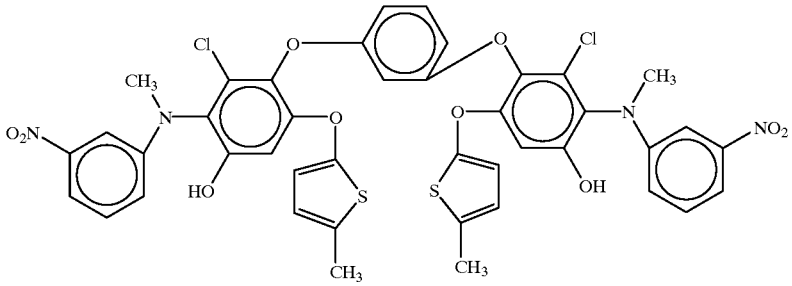 |
| 12 | 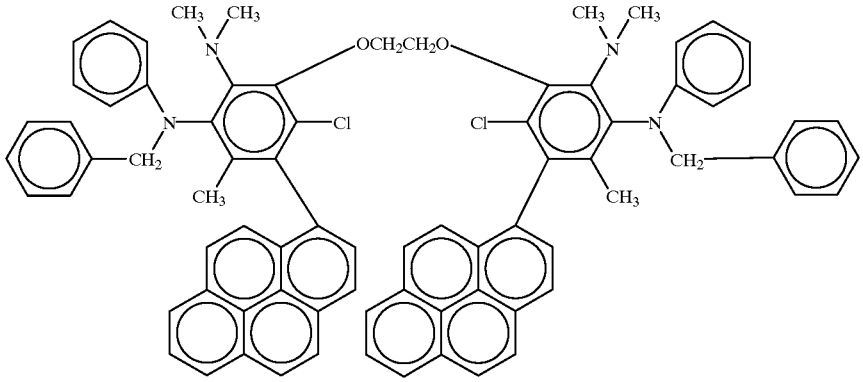 |
| 13 | 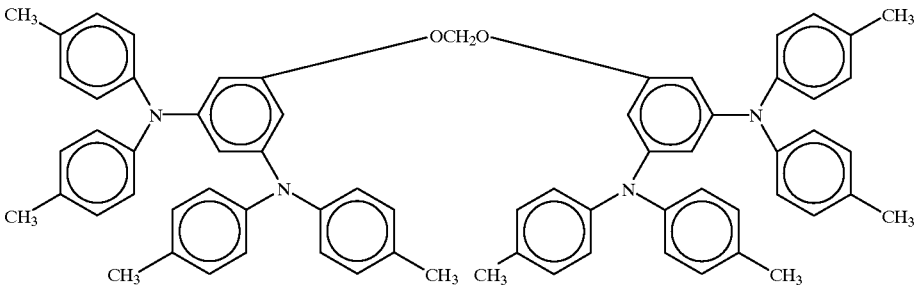 |

TABLE 1-continued

| Compound No. | Compound |
|---|---|
| 14 | 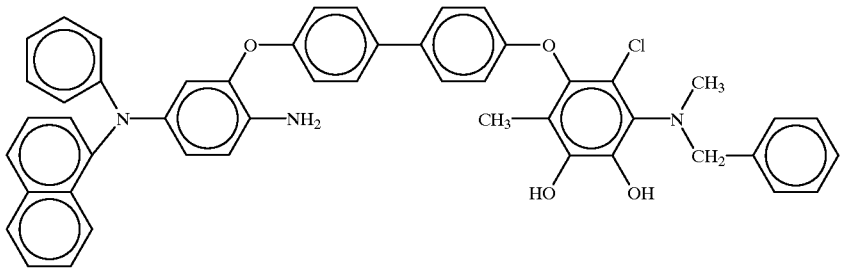 |
| 15 | 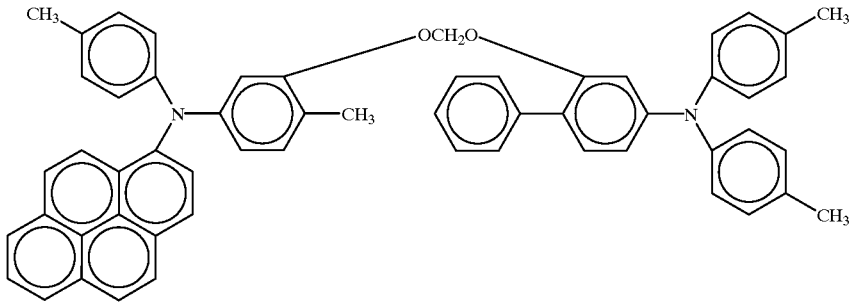 |
| 16 | 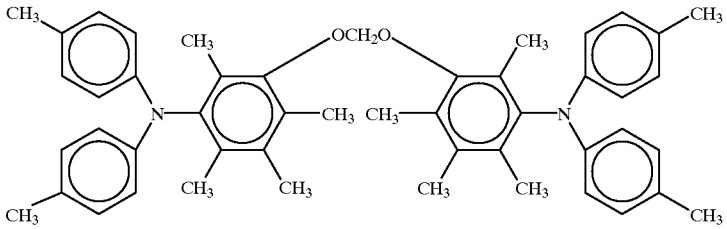 |

The arylamine compound of the formula (I) may be prepared by known methods. For example, a desired compound may be obtained through the Ullman reaction of a diamino compound. This method will be illustrated below.

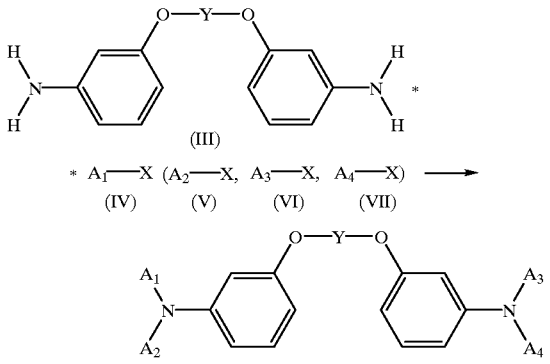

According to this method, a diamino compound of the formula (III) (in which Y has the same definition as in the formula (I)) is allowed to react with a halogen compound of the formula (IV) (in which $A_1$ has the same definition as that in the formula (I), and X represents a halogen atom, such as a bromine atom or an iodine atom), without a solvent, or in a solvent such as nitrobenzene, in the presence of copper powder or copper compound as a catalyst, and also in the presence of a base, such as $K_2CO_3$ or KOH, (Ullman reaction), thereby to provide an arylamine compound of the formula (I).

Depending upon the case, four types of halogen compounds of the formulas (IV), (V), (VI) and (VII) (in which $A_2$, $A_3$ and $A_4$ have the same definition as that in the formula (I)) may be mixed with the diamino compound, or the compounds of the general formulas (IV), (V), (VI) and (VII) may be successively allowed to react in turn with the diamino compound, to thus provide an asymmetric arylamine compound of the formula (I).

In these reactions, a highly pure product can be obtained by known purification processes, such as recrystallization or column purification, upon completion of each process, or upon completion of the whole process, depending upon the case.

The electrophotographic photoreceptor of the present invention includes a photosensitive layer that contains one type or two or more types of arylamine compounds of the formula (I) as indicated above.

The photosensitive layer can include a charge transporting layer, formed of the compound of the formula (I), and charge generating particles that generate electric charge carriers with a considerably high yield upon absorption of light. In embodiments, the photosensitive layer can be a laminated structure including a charge transporting layer formed of the compound of the formula (I) and a charge generating layer comprising charge generating particles and a binder.

In addition to the arylamine compound of the formula (I), the photosensitive layer may further contain other compounds showing excellent characteristics or performance when used as an organic photoconductor, such as another known arylamine compound, a hydrazone compound, a stilbene compound, an enamine compound, and others.

Where the photosensitive layer consists of two layers, i.e., a charge carrier generation layer and a charge carrier transport layer, and the arylamine compound of the formula (I) is used in the charge carrier transport layer, the resulting photoreceptor has an especially high sensitivity, and low residual potential, and is less likely to suffer from fluctuations in the surface potential, a decrease in the sensitivity, and accumulation of the residual potential, over a long period of repeated use, thus assuring excellent durability.

The electrophotographic photoconductor of the present invention can be produced according to a conventional method. More specifically, a coating solution is prepared by dissolving the arylamine compound of the formula (I) with a binder, in a suitable solvent, and adding, as needed, charge carrier generation material particles that generate charge carriers with a considerably high yield upon absorption of light, a sensitizing dye, an electron acceptor compound, a plasticizer, a pigment, and other additives, to the solution of the arylamine compound. The thus prepared coating solution is applied by coating to a conductive substrate, and dried, thereby to form a photosensitive layer that generally has a thickness of several microns to several dozens of microns, preferably, 10 microns to 40 microns. In the case where a photosensitive layer consisting of two layers of a charge carrier generation material and a charge transport material is to be produced, the above-described coating layer may be coated on a charge carrier generation layer, or a charge carrier generation layer may be coated on a charge carrier transport layer that is obtained by coating the above-described coating solution on a conductive substrate.

The solvent used for the coating solution may be selected from various types of solvents in which the arylamine compound can be dissolved. For example, the solvent can include ethers such as tetrahydrofuran and 1,4-dioxane; ketones such as methyl ethyl ketone and cyclohexanone; aromatic hydrocarbons such as toluene and xylene; aprotic polar solvents such as N,N-dimethylformamide, acetonitrile, N-methylpyrolidone, and dimethylsulfoxide; esters such as ethyl acetate, methyl acetate, and methylcellosolve acetate; chlorinated hydrocarbons such as dichloroethane and chloroform. Needless to say, solvents capable of dissolving the binder should be selected from these solvents.

The binder may be selected from various types of polymers having a compatibility with the arylamine compound. For example, the binder can include polymers and copolymers of vinyl compounds, such as styrene, vinyl acetate, vinyl chloride, acrylic ester, methacrylic ester, and butadiene; polyvinyl acetal; polycarbonate; polyester; polystyrene; polyphenylene oxide; polyurethane; cellulose ester; cellulose ether; phenoxy resin; silicon resin; and epoxy resin. The amount of binder is generally 0.5 to 30 times by weight, preferably, 0.7 to 10 times by weight, as much as that of the arylamine compound.

The charge carrier generation material particles, dye, and the electron acceptor compound that are added to the above photosensitive layer may be selected from conventional substances or compounds. The charge carrier generation material particles that generate charge carriers with a considerably high yield upon absorption of light may be selected from inorganic charge carrier generation material particles, such as selenium, selenium-tellurium alloy, selenium-arsenic alloy, cadmium sulfide, and amorphous silicon; and organic charge carrier generation material particles, such as metal containing phthalocyanine, perylene pigment, thioindigo, quinacridone, anthraquinone pigment, azo pigment, bisazo pigment, trisazo pigment, tetrakis azo pigment, and cyanine pigment. In particular, the bisazo pigment is preferably combined with the arylamine compound, to provide an excellent photoreceptor having improved sensitivity and low residual potential.

Preferably, the arylamine compound of the formula (I) is used as the charge carrier transport material formed on the conductive substrate, and the azo pigment having a coupler component of the formula (II) below is used as the charge generating material.

(II)

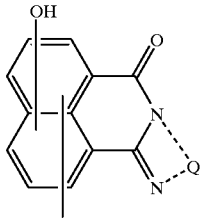

where Q is a substituted or unsubstituted bivalent heterocyclic group, or a substituted or unsubstituted bivalent aromatic hydrocarbon group. The bivalent heterocyclic group may be, for example, a 3,4-pyrazolediyl group; a 2,3-pyridinediyl group; a 3,4-pyridinediyl group; a 4,5-pyrimidinediyl group; a 6,7-indazolediyl group; a 5,6-benzimidazolediyl group, or a 5,6-quinolinediyl group. The bivalent aromatic hydrocarbon group may be, for example, a bivalent monocyclic aromatic hydrocarbon such as an o-phenylene group; or a bivalent 1. condensed polycyclic aromatic hydrocarbon such as o-naphthylene group, 1,8-naphthylene group, 1,2-anthraquinonylene group, and 9,10-phenanthrilene group.

According to the present invention, these bivalent heterocyclic group and the bivalent aromatic hydrocarbon group may have substituents. Typical examples of such substituents include an alkyl group such as a methyl group, an ethyl group, a n-propyl group, a i-propyl group, a n-butyl group, a i-buthyl group, and a n-hexyl group; a trifluoromethyl group; an alkoxy group such as a methoxy group, an ethoxy group, a propoxy group, and a butoxy group; a hydroxyl group; a nitro group, a cyano group; an amino group; a substituted amino group such as a dimethylamino group, a diethylamino group and a dibenzylamino group; a halogen atom such as a fluorine atom, a chloride atom, a bromine atom, and an iodine atom; a carboxyl group; an alkoxycarbonyl group such as an ethoxycarbonyl group; a carbamoyl group; an acyl group such as an acetyl group and a benzoyl group; an aryloxy group such as a phenoxy group; an arylalkoxy group such as a benzyloxy group; and an aryloxycarbonyl group such as a phenyloxycarbonyl group. Among them, the alkyl group, alkoxy group, nitro group, halogen atom, hydroxy group, carbamoyl group, more specifically, the methyl group, methoxy group, nitro group, chlorine atom, and hydroxy group, are preferably used.

Typical examples of coupler components of the formula (II) are indicated in TABLE 2 below. It is, however, to be understood that these typical examples are shown for illustrative purpose only, and the coupler component used in the present invention is not limited to these examples.

TABLE 2
| | Structural Formula |
|---|---|
| 1 | 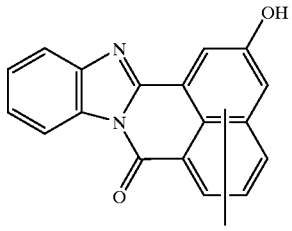 AND 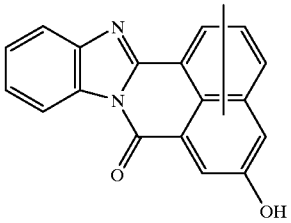 |
| 2 | 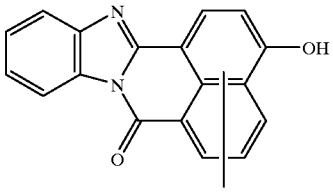 AND 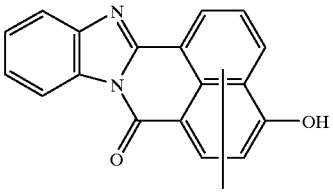 |
| 3 | 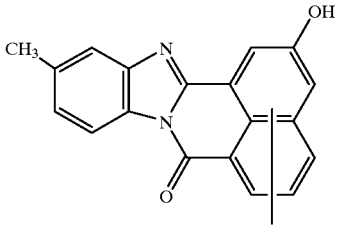 AND 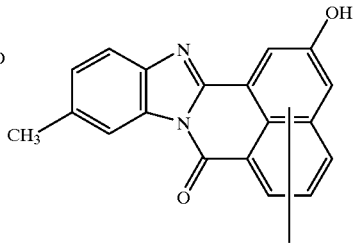 |
| 4 | 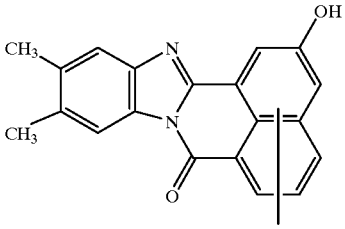 |
| 5 | 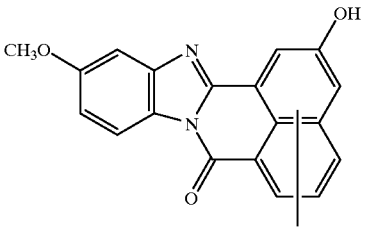 OR 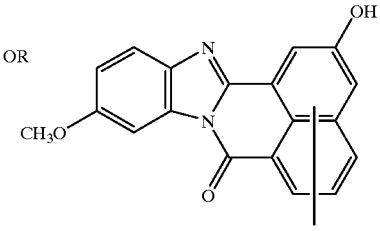 |
| 6 | 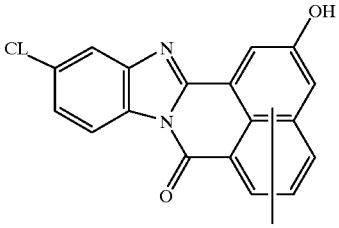 OR 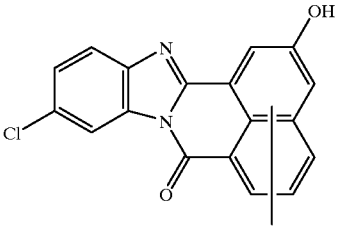 |

TABLE 2-continued
| | Structural Formula |
|---|---|
| 7 | 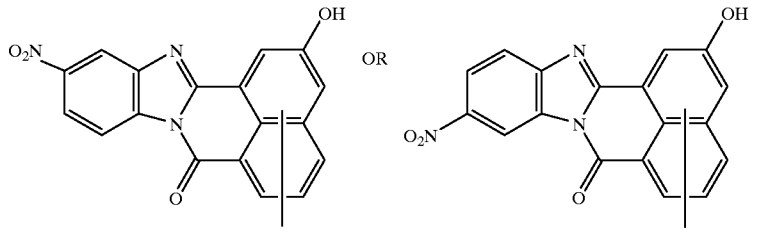 |
| 8 | 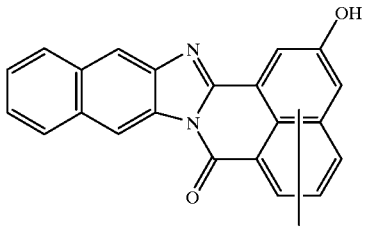 |
| 9 | 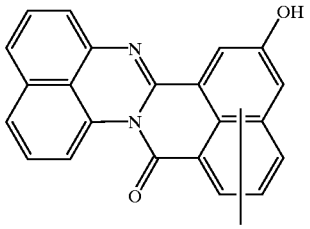 |
| 10 | 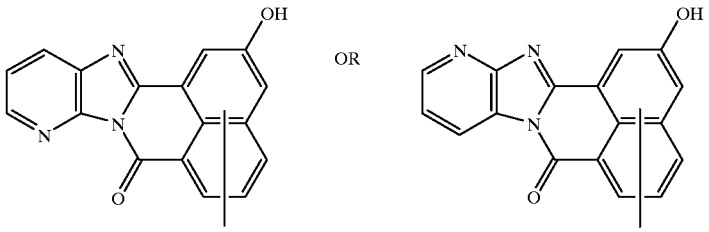 |
| 11 | 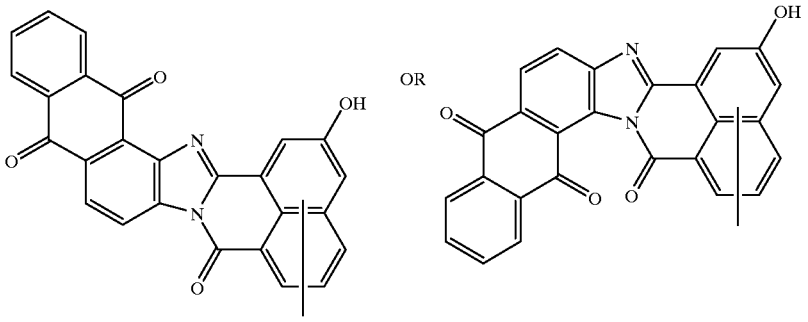 |

TABLE 2-continued

| | Structural Formula |
|---|---|
| 12 | 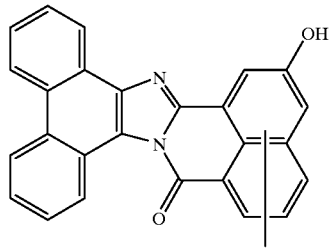 |
| 13 | 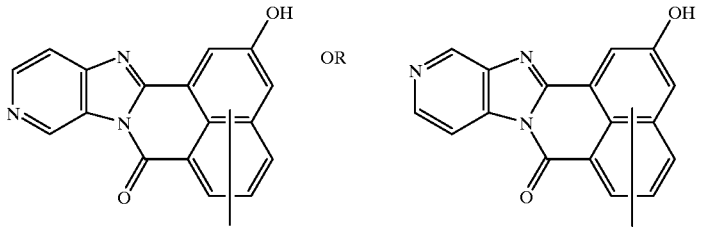 |

Typical examples of the dye include a triphenylmethane dye such as methyl violet, brilliant green and crystal violet; a thiazine dye such as methylene blue; a quinone dye such as quinizarin, a cyanine dye, pyrylium salt, thiapyrylium salt, and benzopyrylium salt. Typical examples of the electron acceptor compound that cooperates with the arylamine compound to form a charge transport complex include quinones such as chloranil, 2,3-dichloro-1,4-naphthoquinone, 1-nitroanthraquinone, 1-chloro-5-nitroanthraquinone, 2-chloroanthraquinone, and phenanthrenequinone; aldehydes such as 4-nitrobenzaldehyde; ketones such as 9-benzoanthracene, indandione, 3,5-dihydrobenzophenone, 2,4,7-trinitrofluorenone, 2,4,5,7-tetranitrofluorenone, and 3,3',5,5'-tetranitrobenzophenone; acid anhydrides such as phthalic anhydride, and 4-chloronaphthalic anhydride; cyano compounds such as tetracyanoethylene, terephthalmalononitrile, 9-anthrylmethylidenemalononitrile, 4-nitrobenzalmalononitrile, and 4-(p-nitrobenzoisooxy) benzalmalononitrile; phthalides such as 3-benzalphthalide, 3-(α-cyano-p-nitrobenzal) phthalide, and 3-(α-cyano-p-nitrobenzal)-4,5,6,7-tetrachlorophthalide.

The electrophotographic photoreceptor of the present invention may further contain a known plasticizer, for improvement of the film-formability, flexibility, and the mechanical strength. Therefore, the plasticizer added to the above-described coating solution may be selected from phthalic acid ester, phosphoric acid ester, epoxy compound, chlorinated paraffin, chlorinated fatty acid ester, an aromatic compound such as methylnaphthalene, and the like.

While the coating solution in which the arylamine compound is used as a charge carrier transport material in the charge carrier transport layer may have the composition as described above, the charge carrier generation material particles, dye, electron acceptor compound and other additives may be eliminated or added only in small amounts. In this case, the charge carrier generation layer may be formed by preparing a coating solution in which the above charge carrier generation material particles, and the binder polymer, organic photoconductive substance, dye, electron acceptor compound, and others, as needed, are dissolved or dispersed in a solvent, and coating and drying the coating solution, so as to form a thin layer. Alternatively, the charge carrier generation layer may be formed by depositing the above-indicated charge carrier generation material by vapor deposition or other method.

The electrophotographic photoreceptor of the present invention may farther contain a known additive for improvement of the electric characteristics and/or the durability over a certain period of repeated use. Therefore, the additive to be added to the above coating solution may be selected from phenol compounds, amine compounds, organic phosphorous compounds, organic sulfur compounds, and others. Typical examples of the phenol compounds, amine compounds, organic phosphorous compounds, and organic sulfur compounds may be selected from those having the structures as indicated below:

(1) Phenol compounds: dibutylhydroxytoluene, 2,2'-methylene-bis (6-t-butyl-4-methylphenol), 4,4'-buthylidene-bis (6-t-butyl-3-methylphenol), 4,4'-thio-bis (6-t-butyl-3-methylphenol), 2,2'-butylidene-bis (6-t-butyl-4-methylphenol), α-tocopherol, β-tocopherol, 2,2,4-trimethyl-6-hydroxy-7-t-butylchroman, pentaerystiltetrakis [3-(3,5-di-t-butyl-4-hydroxyphenyl) propionate], 2,2'-thioethylene-bis [3-(3,5-di-t-butyl-4-hydroxyphenyl) propionate], 1,6-hexanediol-bis [3-(3,5-di-t-butyl-4-hydroxyphenyl) propionate], butylhydroxyanisole, dibutylhydroxyanisole, 1-[2-{(3,5-di-butyl-4-hydroxyphenyl) propionyloxy} ethyl]-4-[3-(3,5-di-butyl-4-hydroxyphenyl) propionyloxy]-2,2,6,6-tetramethylpiperazyl, 2,4-bis-(n-octylthio)-6-(4-hydroxy-3,5-di-t-buthylanilino)-1,3,5-triazine, 1,3,5-trimethyl-2,4,6-tris (3,5-di-t-butyl-4-hydroxybenzyl) benzene, 2-(5-methyl-2-hydroxyphenyl) benzotriazole, 2-(3-t-butyl-5-methyl-2-hydroxyphenyl)-5-chlorobenzotriazole, 1-[2-{3-(3,5-di-t-butyl-4-hydroxyphenyl) propionyloxy} ethyl]-4-{3-(3,5-di-t-butyl-4-hydroxyphenyl) propionyloxy}-2,2,6,6-tetramethylpiperidine, octadecyl-3(3,5-di-t-butyl-4-hydroxyphenyl) propionate, and others;

(2) Amine compounds: N-phenyl-N'-isopropyl-p-phenylenediamine, N,N'-di-sec-butyl-p-phenylenediamine, N-phenyl-N-sec-butyl-p-phenylenediamine, N,N'- diisopropyl-p-phenylenediamine, N,N'-dimethyl-N,N'-dibutyl-p-phenylenediamine, tribenzylamine, and others;

(3) Organic phosphorous compounds: triphenylphosphine, tri (nonylphenyl) phosphine, tri (dinonylphenyl) phosphine, tricresyl phosphine, tri (2,4-dibuthylphenoxy) phosphine, tris (2,4-di-t-buthylphenyl) phosphite, and others;

(4) Organic sulfur compounds: dilauryl-3,3'-thiodipropionate, distearyl-3,3'-thiodipropionate, ditetradecyl-3,3'-thiodipropionate.

Needless to say, the photoreceptor formed in the manner as described above may include, as needed, an adhesive layer, an intermediate layer, a transparent insulating layer, and others.

The conductive substrate on which the photosensitive layer is formed may be any type of substrate used in conventional electrophotographic photoreceptors. More specifically, the conductive substrate may be in the form of a metallic drum or sheet formed of aluminum, stainless steel, copper, or the like, or a laminated structure of metallic films of these metals, or a deposit of these metals. The conductive substrate may also be selected from a plastic film, plastic drum, paper, paper tube, or the like, which is coated with a conductive material, such as metal powder, carbon black, copper iodide, polyelectrolyte, or the like, along with a binder, to be given electric conductivity. Another type of conductive substrate may be a plastic sheet or drum that contains a conductive substance, such as metal powder, carbon black, carbon fiber, or the like, and is thus given conductivity.

EXAMPLES

Some examples of the present invention will be now described in detail. It is, however, to be understood that the present invention is not limited to Synthesis Example 1 and the Examples, but may be otherwise embodied without departing from the principal of the invention. In the examples below, the term "parts" means "parts by weight".

Synthesis Example 1

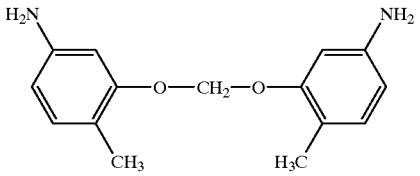

Initially, 10 g of a diamino compound having the structure as indicated above, 51 g of p-iodotoluene, 21 g of potassium carbonate, and 9.8 g of copper powder were mixed together, and allowed to react with one another at 200° C. for 8 hours. After cooling at room temperature, 10 ml of toluene was added to dissolve the reactive product, which was then filtered so that potassium carbonate and copper powder were removed. The resultant filtrate was concentrated, and purified by an conventional method, so as to provide 7.7 g of white crystal (having a melting point of 133 to 135° C.).

The compound prepared in the above manner was analyzed by the mass spectrometry and infrared absorption spectrum (FIG. 1), and found to be an arylamine compound (compound No. 1 in TABLE 1) having the structural formula as indicated below. The result of the mass spectrometry was MW=618 as $C_{43}H_{42}O_2N_2$, $M^+$=618.

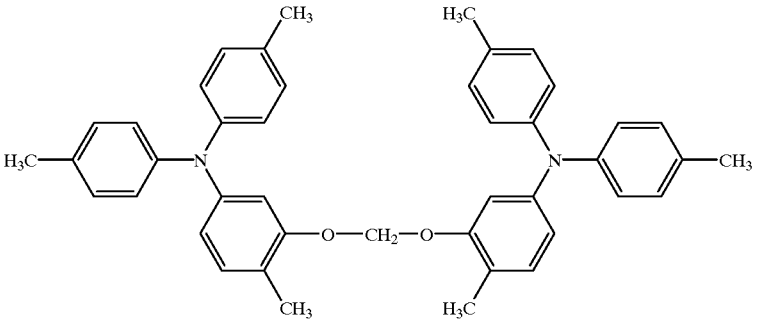

Example 1

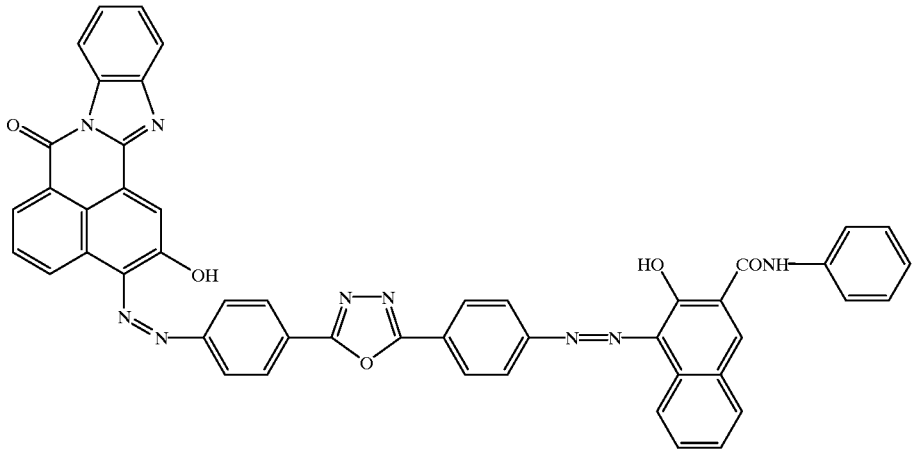

Initially, 1.0 part of naphthalic bisazo pigment as represented by the above structural formula was added to 14 parts of dimethoxyethane, and dispersed therein by a sand grinder. Thereafter, 14 parts of dimethoxyethane and 14 parts of 4-methoxy-4-methyl-2-penthanone (manufactured by Mitsubishi Chemical Corporation) were added for dilution, and the diluted liquid was mixed with a liquid in which 0.5 parts of polyvinyl buthyral (trade name "Denka Buthyral" #6000 - C, manufactured by Denki Kagaku Kogyo K.K.) and 0.5 parts by phenoxy resin (manufactured by Union Carbide Co.) were dissolved in a mixed solution of 6 parts of dimethoxyethane and 4-methoxy-4-methyl-2-penthanone, so as to obtain a dispersion. The dispersion thus obtained was then coated on an aluminum substrate that is vapor deposited on a 75 $\mu$m-thickness polyester film, using a wire bar, so that the weight of the dispersion after drying became equal to 0.4 g/m$^2$. The dispersion was then dried, to form a charge generation layer.

In the meantime, 110 parts of the arylamine compound (Compound No. 1) prepared in Synthesis Example 1 and 100 parts of polycarbonate resin (having a viscosity-average molecular weight of about 30,000) as indicated below were dissolved in a mixed solution of 900 parts of tetrahydrofuran, so as to provide a coating solution. This coating solution was coated on the charge carrier generation layer formed as described above, and then dried, to thus form a charge carrier transport layer having a thickness of 29 $\mu$m.

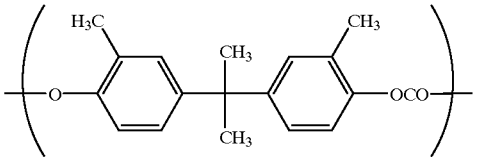

With regard to the resulting electrophotographic photoreceptor having the double layered photosensitive layer, the sensitivity, i.e., half-value exposure amount, was 0.815 lux·sec.

In the measurement of the half-value exposure amount, the photoreceptor was charged with −700V in a dark room, and then exposed to white light of 2 lux, and the exposure amount required for the surface potential to be decayed or reduced from −550V to −275V was measured. Thus, the half-value exposure amount is inversely related to sensitivity. The surface potential was measured when the exposure time was set to 10 sec, as a residual potential, which was found to be −8V.

Example 2

A photoreceptor was produced in the same manner as in Example 1, except that the naphthalic bisazo pigment used in Example 1 was replaced by another type of naphthalic bisazo pigment represented by the structural formula as indicated below.

The half-value exposure amount of the photoreceptor of the present example was 0.980 lux·sec, and the residual potential was −8 V.

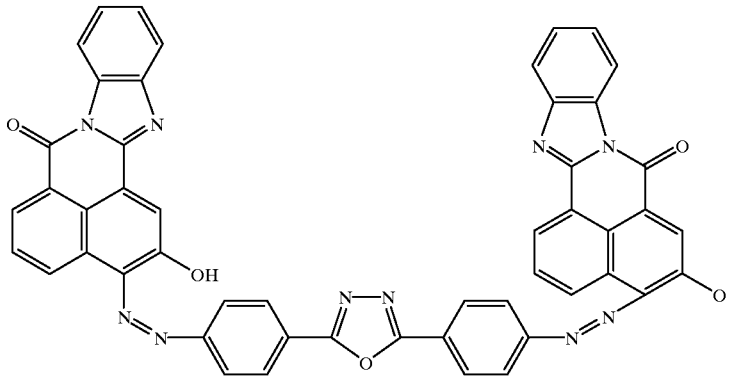

Example 3

A photoreceptor was produced in the same manner as in Example 1, except that the naphthalic bisazo pigment used in Example 1 was replaced by oxytitanium phthalocyanine pigment having strongest diffraction peaks at Bragg angles (2 θ+0.2°) of 9.3°, 13.2°, 26.2°, and 27.1° in its X-ray diffraction spectrum measured with Cu-Kα ray, and that a charge transport layer having a thickness of 20 μm was used which contained 70 parts of arylamine compound, and polycarbonate resin (having a viscometric average molecular weight of 35,000) that has the structure as follows:

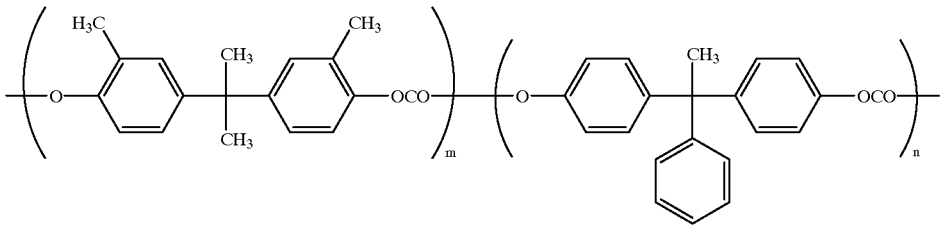

The photoreceptor thus obtained was exposed to 780 nm-wavelength light (having a luminous energy of 500 nW), and its half-value exposure amount was found to be 0.556 $\mu J/cm^2$. The residual potential was −40V.

Example 4

A photoreceptor was produced in the same manner as in Example 3, except that the oxytitanium phthalocyanine pigment used in Example 3 was replaced by oxytitanium phthalocyanine pigment having the main diffraction peak at a Bragg angle (2 θ+0.2°) of 27.3°, in its X-ray diffraction spectrum measured with Cu-K α ray. The half-value exposure amount of the photoreceptor thus obtained was 0.116 $\mu J/cm^2$, and the residual potential was −30V.

Comparative Example 1

A photoreceptor was produced in the same manner as in Example 1, except that the arylamine compound used in Example I was replaced by an arylamine compound represented by the structural formula as indicated below. The half-value exposure amount of the resultant photoreceptor was 0.865 lux·sec, and the residual potential was −12 V.

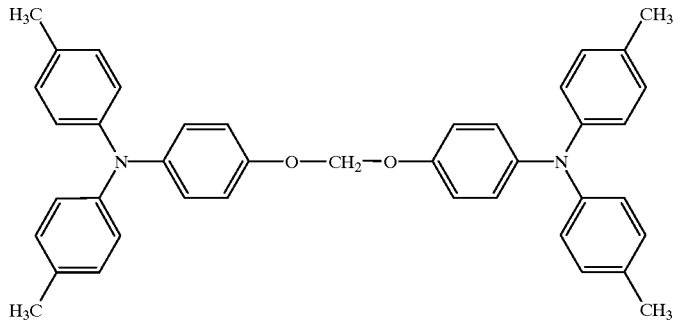

Comparative Example 2

A photoreceptor was produced in the same manner as in Example 1, except that the arylamine compound used in Example 1 was replaced by an arylamine compound represented by the structural formula as indicated below. The half-value exposure amount of the resultant photoreceptor was 0.853 lux·sec. and the residual potential was −9 V.

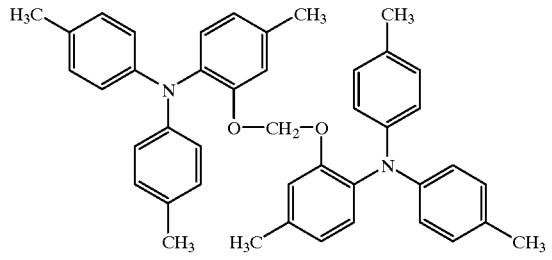

As shown in Example 1, Comparative Example 1 and Comparative Example 2 above, bonding —O—$CH_2$—O— to two phenyl groups at positions meta to respective nitrogen atoms (Example 1) results in a lower half-value exposure amount (higher sensitivity) than is achieved with ortho (Comparative Example 2) and para (Comparative Example 1) bonding. The lack of methyl groups on the phenyl groups bonded to —O—$CH_2$—O— in Comparative Example 1 does not effect the half-value exposure amount.

The electrophotographic photoreceptor of the present invention has a considerably high sensitivity. In particular, the present photoreceptor has reduced light fatigue and reduced fluctuation in the surface potential and the sensitivity, thus assuring high durability. The photoreceptor of the present invention is not only suitable for PPC, but also suitably used for printers, such as laser printers, liquid crystal shutter printers, and LED printers, which are particularly required to operate with high stability and reliability.

Obviously, numerous modifications and variations of the present invention are possible in light of the above teachings. It is therefore to be understood that within the scope of the appended claims, the invention may be practiced otherwise than as specifically described herein.

The disclosure of the priority document, Application No. 10-155815, which was filed in Japan on Jun. 4, 1998, is incorporated by reference herein in its entirety.

What is claimed is:

1. An electrophotographic photoreceptor comprising a conductive substrate and a photosensitive layer on the conductive substrate, wherein the photosensitive layer contains an arylamine compound of a formula (I):

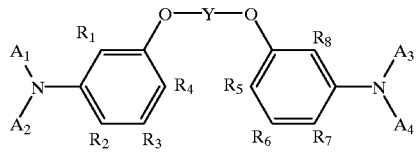

(I)

$A_1$, $A_2$, $A_3$ and $A_4$ each independently represents a substituted or unsubstituted group selected from an alkyl group, an aralkyl group, an aryl group, a heterocyclic group and a condensed polycyclic group;

Y represents a substituted or unsubstituted group selected from an alkylene group, an aralkylene group, an alkenylene group, an arylene group, and a bivalent heterocyclic group; and $R_1$, $R_2$, $R_3$, $R_4$, $R_5$, $R_6$, $R_7$ and $R_8$ each independently represents a hydrogen atom or a substituent selected from a hydroxyl group, a halogen atom, and a substituted or unsubstituted group selected from an alkyl group, an alkoxy group, an aralkyl group, an aralkyloxy group, an aryl group, an aryloxy group, a heterocyclic group, a heterocyclicoxy group, a condensed polycyclic group and an amino group.

2. The electrophotographic photoreceptor according to claim 1, wherein $A_1$, $A_2$, $A_3$ and $A_4$ each independently represents a substituted or unsubstituted aryl group.

3. The electrophotographic photoreceptor according to claim 1, wherein Y represents a substituted or unsubstituted alkylene group.

4. The electrophotographic photoreceptor according to claim 1, wherein $R_1$, $R_2$, $R_3$, $R_4$, $R_5$, $R_6$, $R_7$, and $R_8$ each independently represents a hydrogen atom, or a substituted or unsubstituted alkyl group.

5. The electrophotographic photoreceptor according to claim 1, wherein at least one of $R_4$and $R_5$ represents a hydroxyl group, a halogen atom, or a substituted or unsubstituted group selected from an alkyl group, an alkoxy group, an aralkyl group, an aralkyloxy group, an aryl group, an aryloxy group, a heterocyclic group, a heterocyclicoxy group, a condensed polycyclic group and an amino group.

6. The electrophotographic photoreceptor according to claim 1, wherein the photosensitive layer contains at least a charge carrier generation material and a charge carrier transport material, and the charge carrier transport material comprises the arylamine compound of the formula (I).

7. The electrophotographic photoreceptor according to claim 1, wherein the photosensitive layer comprises at least a charge carrier generation layer and a charge carrier transport layer;

the charge carrier generation layer includes a charge carrier generation material and a charge generation layer binder; and the charge carrier transport layer includes a charge carrier transport material comprising the arylamine compound of the formula (I).

8. The electrophotographic photoreceptor according to claim 7, wherein the charge carrier transport layer comprises the charge carrier transport material and a charge carrier transport layer binder.

9. The electrophotographic photoreceptor according to claim 1, wherein the photosensitive layer comprises a charge carrier transport material including the arylamine compound of the formula (I), and a charge carrier generation material including an azo pigment having in each molecule a coupler of the formula (II):

(II)

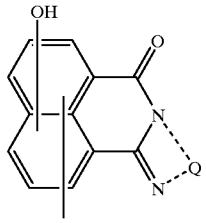

wherein Q is a substituted or unsubstituted bivalent heterocyclic group or a substituted or unsubstituted bivalent aromatic hydrocarbon group.

10. The electrophotographic photoreceptor according to claim 1, wherein the photosensitive layer comprises a charge carrier transport material including the arylamine compound of the formula (I); and a charge carrier generation material including at least one of oxytitanium phthalocyanine having a main diffraction peak at a Bragg angle (2 θ±0.2°) of 27.3° in an X-ray diffraction spectrum measured with Cu-$K_\alpha$ X-rays, and oxytitanium phthalocyanine having diffraction peaks at Bragg angles (2 θ±0.2°) of 9.3°, 13.2°, 26.2°, and 27.1° in an X-ray diffraction spectrum measured with Cu-$K_\alpha$ X-rays.

11. A method of manufacturing an electrophotographic photoreceptor, the method comprising forming the electrophotographic photoreceptor of claim 1.

12. An electrophotographic method comprising using the electrophotographic photoreceptor of claim 1.

* * * * *